US006874187B2

(12) United States Patent
Tague et al.

(10) Patent No.: US 6,874,187 B2
(45) Date of Patent: Apr. 5, 2005

(54) OPENER FOR MEDICAL CONTAINER AND TOOL

(75) Inventors: Christopher M. Tague, Portage, MI (US); Kris D. Eager, Richland, MI (US)

(73) Assignee: Stryker Instruments, Kalamazoo, MI (US)

( * ) Notice: Subject to any disclaimer, the term of this patent is extended or adjusted under 35 U.S.C. 154(b) by 127 days.

(21) Appl. No.: 10/288,030

(22) Filed: Nov. 5, 2002

(65) Prior Publication Data

US 2003/0208850 A1 Nov. 13, 2003

Related U.S. Application Data

(60) Provisional application No. 60/379,511, filed on May 9, 2002.

(51) Int. Cl.[7] ..... B67B 7/00

(52) U.S. Cl. ..... 7/151; 225/93; 81/3.07

(58) Field of Search ..... 7/151, 105, 169; 225/93, 97, 101; 81/3.07, 3.4, 3.41

(56) References Cited

U.S. PATENT DOCUMENTS

| | | | | | |
|---|---|---|---|---|---|
| 37,920 | A | * | 3/1863 | Penny | 7/138 |
| 1,779,293 | A | * | 10/1930 | Rodgers | 403/302 |
| 2,046,334 | A | | 7/1936 | Loeber | |
| 2,503,517 | A | * | 4/1950 | Sirica | 30/94 |
| 2,624,489 | A | | 1/1953 | Wishart | |
| 2,860,858 | A | | 11/1958 | Kurs | |
| 2,900,656 | A | | 8/1959 | Tupper | |
| D188,593 | S | | 8/1960 | Tegarty | |
| 3,411,723 | A | | 11/1968 | Kohn | |
| 3,450,319 | A | | 6/1969 | Ray et al. | |
| 3,954,030 | A | * | 5/1976 | Newton | 81/3.55 |
| 4,226,376 | A | * | 10/1980 | Pfleger | 241/99 |
| 4,241,627 | A | * | 12/1980 | Snow | 81/3.55 |
| 4,350,445 | A | | 9/1982 | Olsson | |
| 4,405,067 | A | | 9/1983 | Caron | |
| 4,405,069 | A | * | 9/1983 | Vivier et al. | 225/93 |
| 4,409,863 | A | * | 10/1983 | Anderson | 81/3.09 |
| 4,506,817 | A | * | 3/1985 | Parker | 225/96.5 |
| 4,508,250 | A | * | 4/1985 | Punchak | 225/97 |
| 4,570,838 | A | | 2/1986 | Szemere et al. | |
| 4,637,139 | A | * | 1/1987 | Chen | 30/164.9 |
| 4,659,024 | A | * | 4/1987 | Frunzi et al. | 241/99 |
| 4,793,538 | A | * | 12/1988 | Blomberg | 225/93 |
| 5,054,338 | A | | 10/1991 | Weis | |
| 5,103,520 | A | | 4/1992 | Mazzo | |
| 5,549,380 | A | | 8/1996 | Lidgren et al. | |
| 5,875,515 | A | | 3/1999 | Dallas | |
| 6,006,384 | A | * | 12/1999 | Toal | 7/105 |
| 6,244,487 | B1 | | 6/2001 | Murray | |
| 6,247,736 | B1 | | 6/2001 | Esterson et al. | |
| 6,257,474 | B1 | | 7/2001 | Jones et al. | |

* cited by examiner

*Primary Examiner*—Hadi Shakeri
(74) *Attorney, Agent, or Firm*—Howard & Howard

(57) ABSTRACT

An opener and tool for breaking medical containers, such as, for example, ampoules that includes an elongated handle which has a first end and a second end, an upper edge and a lower edge, and an opener which defines an opening extending into the upper edge at the first end and further defining a flexible cantilevered arm. The opener and tool has at least one arcuate pocket for gripping containers of different sizes between sides of the opening, holding the container and breaking a tip of the container to remove a liquid therefrom for further use with powdered components to produce a mix. The opener and tool also includes a spatula disposed at the second end of the handle.

19 Claims, 3 Drawing Sheets

OPENER FOR MEDICAL CONTAINER AND TOOL

This application claims the benefit of provisional application Ser. No. 60/379,511, filed May 9, 2002.

BACKGROUND OF THE INVENTION

1. Field of the Invention

The subject invention relates to a tool for cracking and opening ampoules and other glass containers.

2. Description of the Prior Art

Numerous ampoule-breaking devices are known in the prior art for breaking open ampoules and vials of the type widely used in the medical industry. U.S. Pat. No. 6,244,487 to Murray, U.S. Pat. No. 4,570,838 to Szemere et al., and U.S. Pat. No. 3,450,319 to Ray et al., disclose a variety of ampoule breaking devices for cracking ampoule and other containers.

The '487 patent to Murray discloses an ampoule breaker that is snapped over an ampoule tip and held in a desired location with a collar flush against a top of an ampoule body, a stiff ring fulcrum support surrounds a score line in the neck of an ampoule wherein the ampoule tip is closely surrounded by a plurality of locating ribs. When the ampoule tip is broken away from the ampoule body by rotating the breaker to one side of the ampoule, the tip is thrown away and the ampoule body is retained for further use.

The '838 patent to Szemere et al. discloses an ampoule opener which comprises a body having a row of holes of different sizes, extending along an edge of the body, to receive ampoule heads of different sizes. An ampoule head is inserted into a selected hole and is snapped off wherein the ampoule body is retained for further use.

The '319 patent to Ray et. al. discloses a device for breaking an ampoule which includes a pair of legs connected at one end to receive the ampoule therebetween. The legs have a neck engaging surfaces on an inner side of the legs to engage with the neck portions of the ampoule to break the ampoule.

In addition to the prior art patents, cited above, U.S. Pat. No. D188,593 shows a design of a household tool for cleaning food mixer bowls and beaters. The household tool shows a spatula that includes a tool for cleaning a flat parts, wherein the tool is disposed at a distal end of the spatula. The tool has two non-movable arms with a slot therebetween to receive the flat part and for cleaning the same.

In the medical field, bone cement is used as a casting and grouting material to implant prosthetic devices into live bone. Bone cement may be made from a cement powder, such as polymethyl methacrylate and the like. The cement powder is mixed with a monomer liquid, such as methyl methacrylate, and other liquids to form a homogeneous bone cement mixture. It is very important to physically mix the dry cement powder and liquid to bring the liquid into contact with the cement powder in order to receive a homogeneous mixture.

Bone cement with an insufficient amount of monomer liquid sets up extremely fast and reduces the already short amount of time available to a surgeon to perform a procedure which requires an application of the bone cement. That is why it is very important to use a tool that may be highly efficient and helpful during surgery.

Known to be hectic and intense, an operating room environment requires certain steps of treatment to be performed quickly. Placing dry components into a mixing container then utilizing an ampoule breaking device to open an ampoule and finally reaching for a spatula to mix the components may take a long time, especially in complicated surgeries. Therefore, there is a need in the medical art for a universal instrument which will comprise several tools, one of which is an ampoule cracker.

BRIEF SUMMARY OF INVENTION

In one aspect of the present invention, an opener for medical container and tool for breaking ampoules comprises an elongated handle and an opener that is disposed adjacent a first end of the elongated handle. The opener defines an opening that further defines a flexible cantilevered arm which surrounds and defines several container engaging pockets for gripping containers of different sizes between sides of the opening, holding the container and breaking a tip of the container to remove a liquid therefrom for further use with other components to produce a mixture.

The present invention provides several advantages over the prior art patents including an effective way of opening ampoules and other glass containers. Therefore, the present invention provides a single tool for accomplishing more than one task

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Referring to the Figures, wherein like numerals indicate like or corresponding parts throughout the several views, an opener for medical container and tool for breaking ampoules and other glass containers is generally shown at 10.

Figure 1:
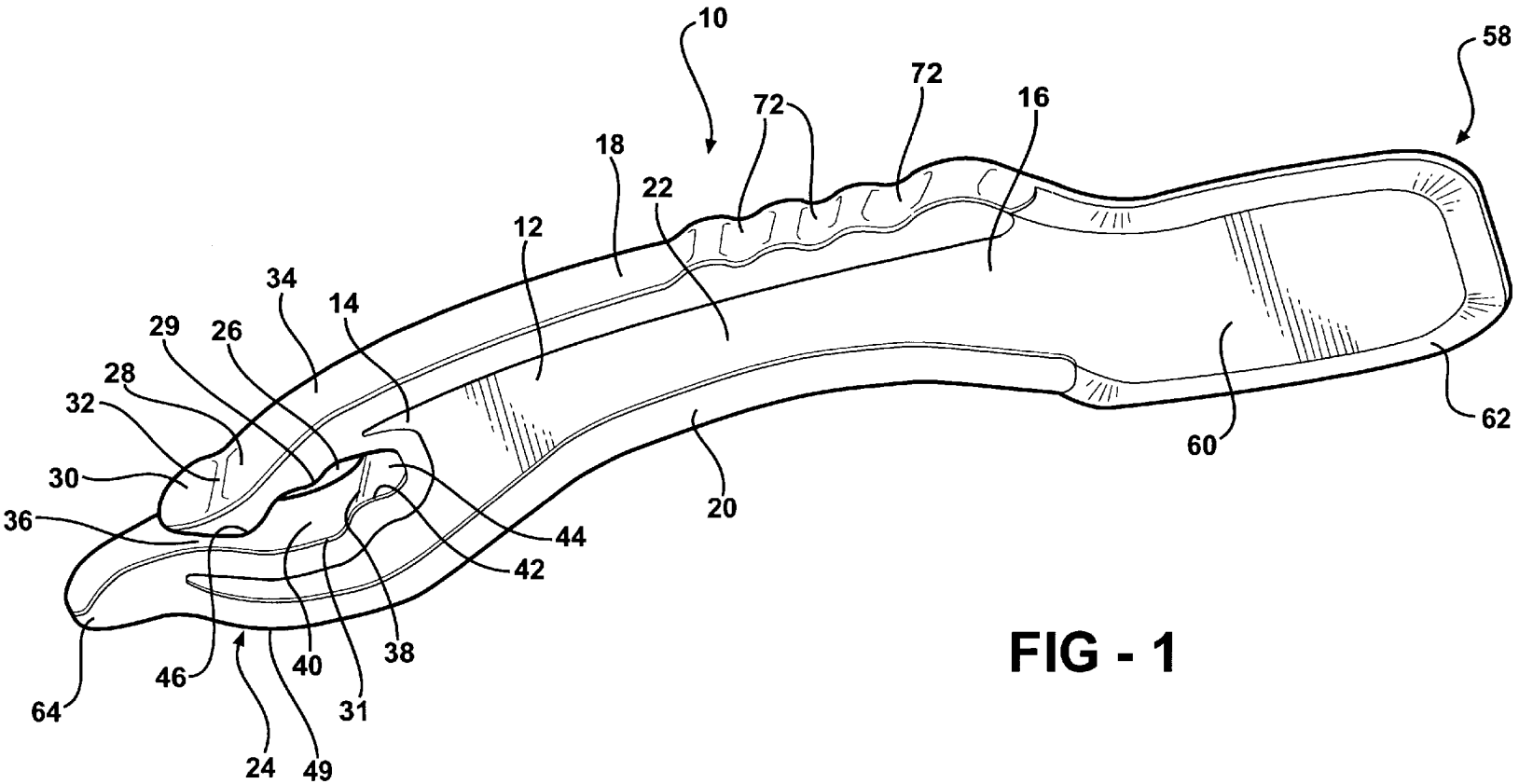
FIG. 1 is a perspective view of an opener for medical container and tool of the subject invention.
Figure 2:
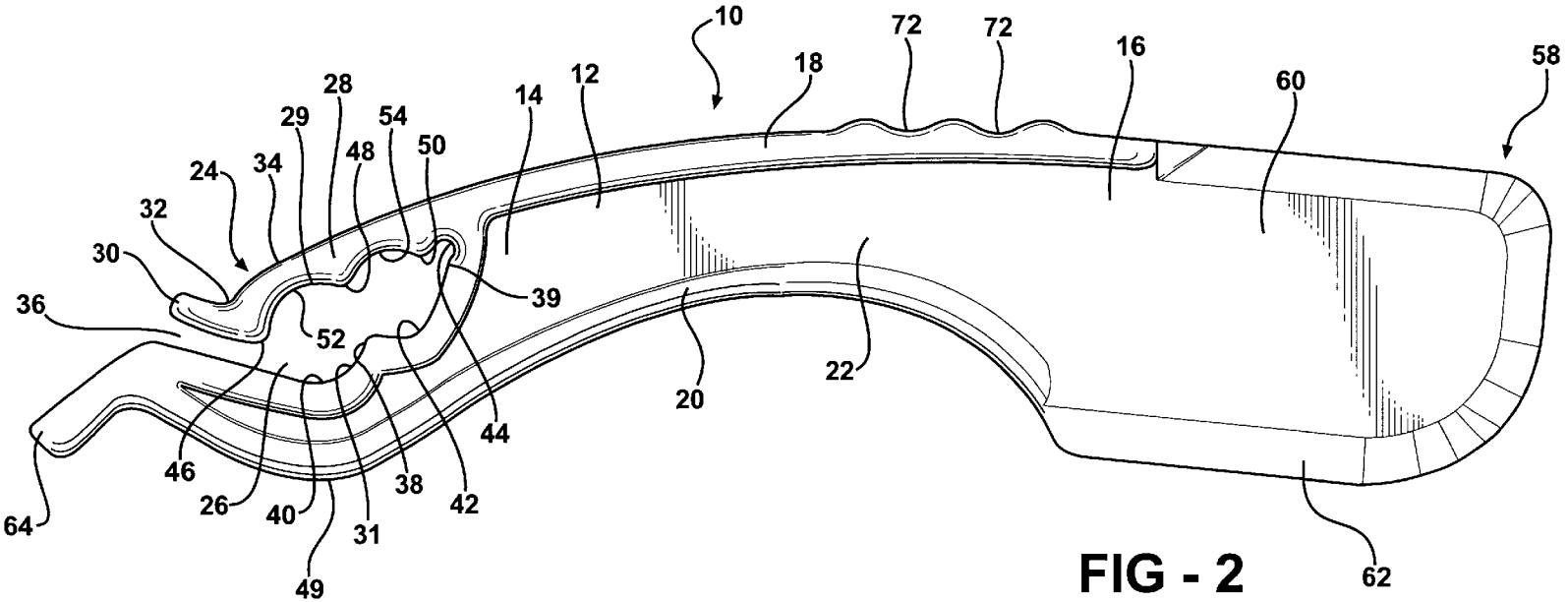
FIG. 2 is a side view of the opener for medical container and tool wherein both sides are identical.
Figure 3:
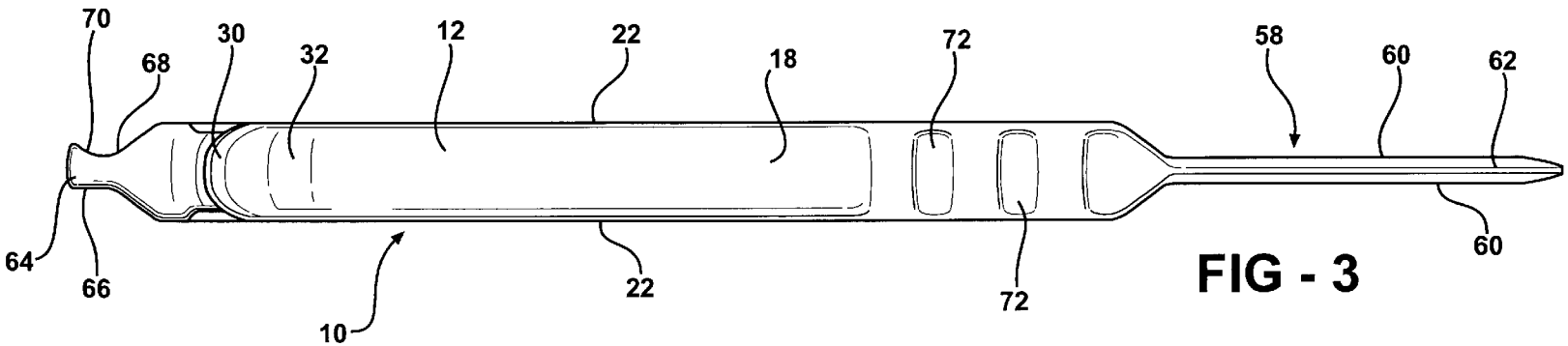
FIG. 3 is a top view of the opener for medical container and tool.

The opener for medical container and tool 10 includes an elongated handle 12, which has a first end 14 and a second end 16. The handle 12 further includes an upper edge 18 and a lower edge 20 wherein both upper edge 18 and the lower edge 20 are interconnected by spaced flat central portions 22. The upper edge 18 of the handle 12 is convexly curved and includes a plurality of thumb indentations 72, as shown in FIGS. 1 through 3, therein adjacent a spatula, generally shown at 58. The indentations 72 are designed for better grasping the tool 10 and manipulating the same while mixing the components and applying the mix to the surface. The lower edge 20 of the elongated handle 12 is concavely curved to a greater degree than the upper edge 18. The lower edge 20 extends into a small concavely curved portion 49 leading into a sculpt 64. The tool 10 has an opener, generally shown at 24 that is disposed adjacent the first end 14 of the tool 10.

The opener 24 defines an opening 26 that extends into the upper edge 18 of the tool 10 and defines a flexible cantilevered arm 28 that surrounds and defines at least one container engaging pocket wherein the flexible cantilevered arm 28 includes a distal end 30 upturned to provide a thumb recess 32 for flexing the flexible cantilevered arm 28 to the lower edge 20 of the elongated handle 12 for gripping containers of different sizes.

The opening 26 further includes an upper side 29 and a lower side 31 defining a plurality of arcuate pockets 40, 42, 44, 52, and 54 along the upper and lower sides for gripping the aforementioned containers between the top 29 and lower 31 sides. The opening 26, as best shown in FIG. 2, leads through a narrow channel 36 adjacent the distal end 30 of the flexible cantilevered arm 28 then runs along the lower side into a first lower peak 38 and a second lower peak 39. The lower side 31 of the opening 26 extends from the first lower peak 38 into another lower arcuate pocket 42 and then upwardly to the second lower peak 39 and downwardly to a small pocket defining an inner end, i.e. small pocket 44 of the opening 26.

The upper side 29 of the opening 26 leads from the channel 36 to a first upper peak 46 followed by a plurality of arcuate pockets defined between a second upper peak 48 and a third upper peak 50. A pocket 52 is located between the first upper peak 46 and the second upper peak 48 wherein the pocket 52 and the first arcuate pocket 40 of the lower side 31 of the opening 26 are oppositely positioned and may be used to grip and hold a container or ampoule of one size. Similarly, the second pocket 54 is disposed opposite to the second pocket 42 of smaller diameter. Preferably, the third peak 50 defines the small pocket 44 that may provide for flexibility and may act as a fulcrum point.

Figure 4:
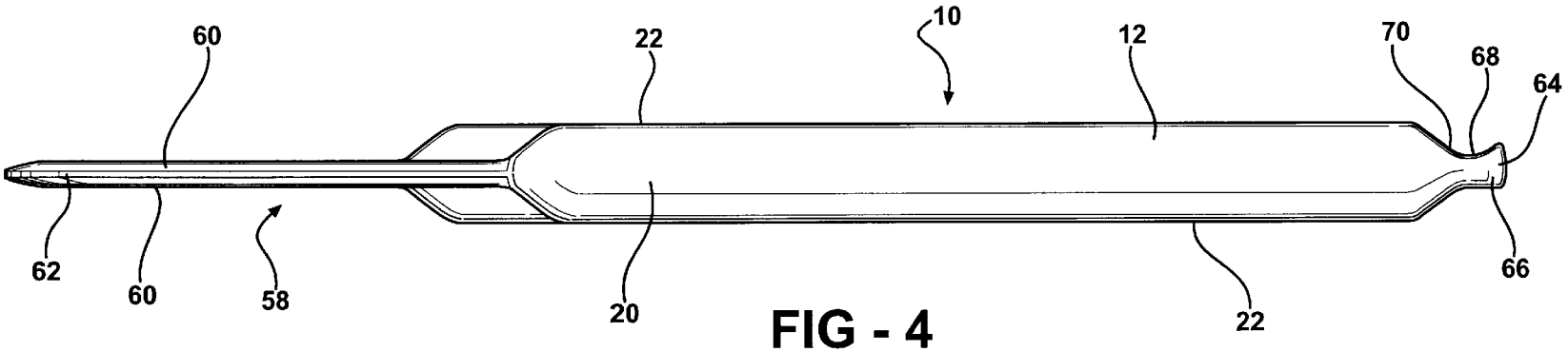
FIG. 4 is a bottom view of the opener for medical container and tool.
Figure 6:
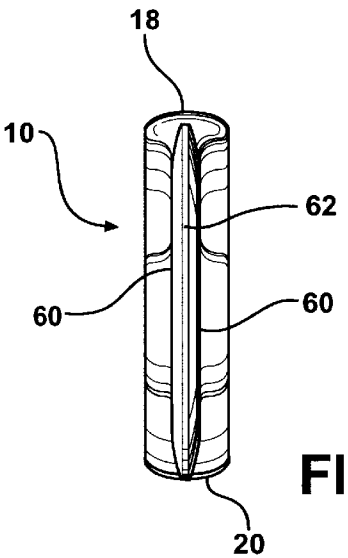
FIG. 6 is an end view taken from the right end of FIG. 2.
Figure 5:
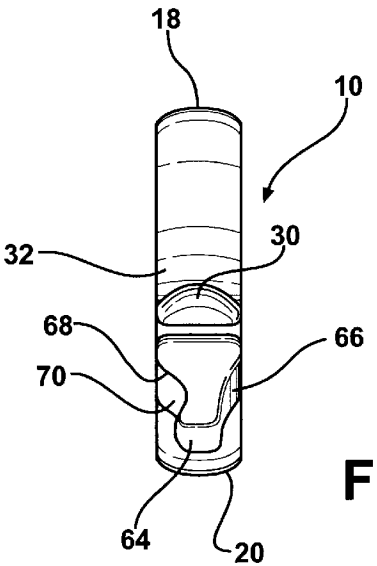
FIG. 5 is an end view taken from the left end of FIG. 2.

In one embodiment, the sculpt 64, extends downwardly from the channel 36 and has two sides 66, 68 wherein the sides 66, 68 of the sculpt 64 are concave with one side 68 curved to a greater degree than the other side 66. In that embodiment, the sculpt 64 may comprise a rigid structure. In another embodiment, the sculpt 64 may be flexible. The difference in degree of a curve forms a scoop 70, as illustrated in FIGS. 3 through 5. Geometry of the scoop 70 is designed to remove excess of the material and to facilitate scraping of the material from narrow grooves and smaller inlets of a surface. As illustrated in FIGS. 3–4, the distance between the sides 66, 68 of the sculpt 64, is less than the distance between the central portions 22 of the handle 12.

As appreciated by those skilled in the art, the alternative embodiment of the sculpt 64 may comprise the sides 66, 68 wherein the sides 66, 68 are straight and do not form the scoop 70 (not shown).

The spatula, generally shown at 58, is disposed adjacent to the second end 16 of the elongated handle 12. The spatula 58 has a middle portion 60 with a flexible flange 62 more narrow that the central portions 22 of the handle 12 and extends from the lower edge 20 and up the second end 16 and partially along the upper edge 18. The distance between the upper edge 18 and the lower 20 edges of the handle 12 is less than the distance between upper and lower edges of the flexible flange 62 extending from the middle portion 60 of the spatula 58. The spatula 58 is used for scraping cement or other components out of a bowl and applying cement to a surface.

The opener for medical container and tool 10 can be formed of a relatively flexible material such as molded plastic wherein the sculpt 64 and the spatula 58 are relatively flexible and can be used on a curvature and an irregular surface when applying the cement and scraping the cement of the surface to remove an excess. Combined in a single body, the opener 24, the sculpt 64, and the spatula 58 may provide an effective and efficient tool to medical practitioners in procedures they perform on daily bases.

Obviously, many modifications and variations of the present invention are possible in light of the above teachings. The invention may be practiced otherwise than as specifically described within the scope of the appended claims.

What is claimed is:

1. A tool, comprising:

an elongated handle having first and second ends and upper and lower edges interconnected by spaced flat central portions;

an opener disposed adjacent said first end and defining an opening extending into said upper edge to define a flexible cantilevered arm including a distal end upturned to provide a thumb recess for flexing said flexible arm to said lower edge of said handle wherein said opening leads through a narrow channel adjacent said distal end and is further defined by a first lower peak and a second lower peak spaced from said first lower peak; and said opener presenting upper and lower sides with a plurality of upper and lower arcuate pockets defined along said upper and lower sides thereof for tripping containers of different sizes between said upper and lower sides.

2. A tool as set forth in claim 1 wherein said lower side extends from said first lower peak into said second lower arcuate pocket and then upwardly to said second lower peak.

3. A tool as set forth in claim 2 wherein said upper side of said opening leads from said channel to a first upper peak extending downwardly and upwardly to a second upper peak to define one of said upper arcuate pockets and then downwardly and upwardly to a third upper peak to define another of said upper arcuate pockets.

4. A tool as set forth in claim 3 wherein said third upper peak and said second lower peak present a small pocket further defining an inner end of said opening.

5. A tool, comprising:

an elongated handle having first and second ends and upper and lower edges interconnected by spaced flat central portions;

an opener disposed adjacent said first end and defining an opening extending into said upper edge to define a flexible cantilevered arm including a distal end upturned to provide a thumb recess for flexing said flexible arm to said lower edge of said handle wherein said opening leads through a narrow channel adjacent said distal end and is further defined by a first lower peak and a second lower peak spaced from said first lower peak;

said opener presenting upper and lower sides with a plurality of upper and lower arcuate pockets defined along said upper and lower sides thereof for gripping containers of different sizes between said upper and lower sides; and a sculpt extending downwardly from said narrow channel.

6. A tool as set forth in claim 5 wherein said sculpt further includes two sides, with one side curved.

7. A tool as set forth in claim 6 wherein both sides of said sculpt are concave with one side curved to a greater degree than the other to form a scoop.

8. A tool as set forth in claim 7 wherein the distance between said sides of said sculpt is less than the distance between said central portions of said handle.

9. A tool as set forth in claim 8 wherein said lower edge is concavely curved to a greater degree than said upper edge.

10. A tool as set forth in claim 9 wherein said lower edge of said handle has a convex curve leading from said concavely curved lower edge into a small convexly curbed portion leading into said sculpt.

11. A tool as set forth in claim 5 wherein said lower edge of said handle concavely curved to a greater degree than said upper edge.

12. A tool as set forth in claim 11 wherein said lower edge of said handle further extends into a small convexly curved portion leading into said sculpt.

13. A tool comprising:

an elongated handle having first and second ends;

said handle having an upper edge and a lower edge interconnected by spaced flat central portions;

an opener disposed adjacent said first end and defining an opening extending into said upper edge to define a flexible cantilevered arm surrounding and defining at least one container engaging pocket; and a spatula disposed at said second end and including a flexible flange more narrow than said flat central portions of said elongated handle and extending from said lower edge and up said second end and partially along said upper edge.

14. A tool as set forth in claim 13, wherein a distance between said upper and lower edges of said handle is less than the distance between said upper and lower edges of said flexible flange of said spatula.

15. A tool, as set forth in claim 13 wherein said upper edge of said handle includes thumb indentations therein adjacent said spatula.

16. A tool, comprising:

an elongated handle having first and second ends, and an upper edge and a lower edge;

flat central portions being spaced and interconnecting said upper and lower edges;

an opener disposed adjacent said first end wherein said opener defines an opening extending between said upper and lower edges;

upper and lower sides of said opener surrounding said opening wherein said top and lower sides define a plurality of upper and lower arcuate pockets for gripping containers of different sizes between said sides;

a flexible cantilevered arm defining an extension of said upper edge wherein said flexible cantilevered arm includes a distal end upturned to provide a thumb recess for flexing said flexible cantilevered arm to grip a container;

a narrow channel defined between said upper and lower sides of said opener adjacent said distal end with said lower side of said opener extending into a first lower peak to define one of said lower arcuate pockets and then to a second lower peak to define another of said lower arcuate pockets;

said upper side of said opener extending into an upper peak and then to a second upper peak to define one of said upper arcuate pockets and then extending to a third upper peak to define another of said upper arcuate pockets;

a small pocket defined by an inner end of said opener;

a spatula disposed at said second end wherein said spatula has a flexible flange for mixing various materials, and a sculpt, extending downwardly from said lower side of said opening wherein said sculpt comprises two sides having a distance therebetween less than a distance between said central portions of said handle.

17. A tool, comprising:

an elongated handle having first and second ends, an upper edge and a lower edge;

flat central portions being spaced and interconnecting said upper and lower edges;

an opener disposed adjacent said first end wherein said opener defines an opening extending into said upper edge to define a flexible cantilevered arm surrounding and defining at least one container engaging pocket, said flexible cantilevered arm including a distal end upturned to provide a thumb recess for flexing said flexible arm to said lower edge of said handle to grip a container;

a spatula disposed at said second end wherein said spatula has a flexible flange for mixing various materials; and a sculpt, extending downwardly from said lower side of said opener wherein said sculpt comprises two sides having a distance therebetween less than a distance between said central portions of said handle.

18. A tool, comprising:

an elongated handle having first and second ends, an upper edge and a lower edge;

flat central portions being spaced and interconnecting said upper and lower edges;

a spatula disposed at said second end wherein said spatula has a flexible flange for mixing various material; and an opener disposed adjacent said first end wherein said opener defines an opening extending into said upper edge to define a flexible cantilevered arm surrounding and defining at least one container engaging pocket, said flexible cantilevered arm including a distal end upturned to provide a thumb recess for flexing said flexible arm to said lower edge of said handle to grip a container.

19. A tool, comprising:

an elongated handle having first and second ends, an upper edge and a lower edge;

flat central portions being spaced and interconnecting said upper and lower edges;

a sculpt, extending downwardly from said lower side of said opener wherein said sculpt comprises two sides having a distance therebetween less than a distance between said central portions of said handle; and an opener disposed adjacent said first end wherein said opener defines an opening extending into said upper edge to define a flexible cantilevered arm surrounding and defining at least one container engaging pocket, said flexible cantilevered arm including a distal end upturned to provide a thumb recess for flexing said flexible arm to said lower edge of said handle to grip a container.

* * * * *